US009108754B2

(12) United States Patent
Ricker et al.

(10) Patent No.: US 9,108,754 B2
(45) Date of Patent: Aug. 18, 2015

(54) HORIZONTAL PLASTIC STRETCH WRAPPING APPARATUS

(76) Inventors: Mark W Ricker, Pen Argyl, PA (US); Donald J Legath, Whitehall, PA (US); Joshua M Ricker, Nazareth, PA (US)

( * ) Notice: Subject to any disclaimer, the term of this patent is extended or adjusted under 35 U.S.C. 154(b) by 613 days.

(21) Appl. No.: 13/565,488

(22) Filed: Aug. 2, 2012

(65) Prior Publication Data

US 2013/0031869 A1 Feb. 7, 2013

Related U.S. Application Data

(60) Provisional application No. 61/514,619, filed on Aug. 3, 2011.

(51) Int. Cl.
*B65B 11/02* (2006.01)

(52) U.S. Cl.
CPC ..... *B65B 11/025* (2013.01); *B65B 2210/20* (2013.01)

(58) Field of Classification Search
CPC ..... B65B 11/00; B65B 11/008; B65B 11/025
USPC ..... 53/556, 203, 218, 219
See application file for complete search history.

(56) References Cited

U.S. PATENT DOCUMENTS

| | | | | | |
|---|---|---|---|---|---|
| 4,905,448 | A * | 3/1990 | Plitt | 53/399 |
| 5,282,346 | A * | 2/1994 | Masuda et al. | 53/118 |
| 5,365,723 | A * | 11/1994 | Ramos | 53/556 |
| 5,390,476 | A * | 2/1995 | Morantz | 53/556 |
| 5,408,808 | A * | 4/1995 | Masuda et al. | 53/556 |
| 5,488,814 | A * | 2/1996 | Rankin et al. | 53/399 |
| 5,787,691 | A * | 8/1998 | Turfan et al. | 53/588 |
| 6,449,928 | B1 * | 9/2002 | Huson | 53/566 |
| 2006/0213155 | A1 * | 9/2006 | Forni et al. | 53/588 |
| 2008/0229714 | A1 * | 9/2008 | Zitella et al. | 53/449 |
| 2008/0307754 | A1 * | 12/2008 | Storig et al. | 53/461 |
| 2010/0300049 | A1 * | 12/2010 | Schmidt et al. | 53/461 |

* cited by examiner

*Primary Examiner* — Gloria R Weeks

(57) ABSTRACT

A horizontal plastic stretch wrapping apparatus includes a main frame, a plurality of control components, an electrical enclosure, a plurality of control buttons, a slip ring, a wrapping arm, and a wrap dispenser. The electrical enclosure and the plurality of control components are positioned within the main frame, and the plurality of control buttons is positioned on the main frame. The plurality of control buttons controls the plurality of control components and the electrical enclosure. The wrap dispenser is connected to the wrapping arm, and the wrapping arm is connected to the main frame. The slip ring is positioned in between the main frame and the wrapping arm and provides electrical power from the electrical enclosure to the wrap dispenser. Once the horizontal plastic stretch wrapping apparatus is powered, a skid can be horizontally wrapped with a wrapping material by the rotating wrapping arm.

16 Claims, 10 Drawing Sheets

DETAIL A
SCALE 1 : 3

DETAIL B
SCALE 1 : 3

HORIZONTAL PLASTIC STRETCH WRAPPING APPARATUS

The current application claims a priority to the U.S. Provisional Patent application Ser. No. 61/514,619 filed on Aug. 3, 2011.

FIELD OF THE INVENTION

The present invention relates generally to an apparatus for wrapping an object. More specifically, the present invention is a machine for horizontally wrapping a skid with products of different sizes and shapes, to be transported by the manufacturer to its customers.

BACKGROUND OF THE INVENTION

Current methods of horizontally wrapping a skid require manual labor. The present method consists of having a lift truck holding the skid in the air, and a laborer using a hand plastic wrap dispenser to wrap the skid from top to bottom. Hand-wrapping the skid with the plastic dispenser requires bending and stretching and can be time-consuming as well as uncomfortable for the laborer. These problems can result in inefficient working environment for employers and injury problems for employees. It is therefore an object of the present invention to provide a machine to wrap the skid horizontally which eliminates the manual labor required as well as the bending and stretching of the laborer when performing this operation. The present invention also significantly improves the workplace safety for the employees while reducing the overhead cost, such as insurance claims, for the employers.

DETAIL DESCRIPTIONS OF THE INVENTION

All illustrations of the drawings are for the purpose of describing selected versions of the present invention and are not intended to limit the scope of the present invention.

Figure 1:
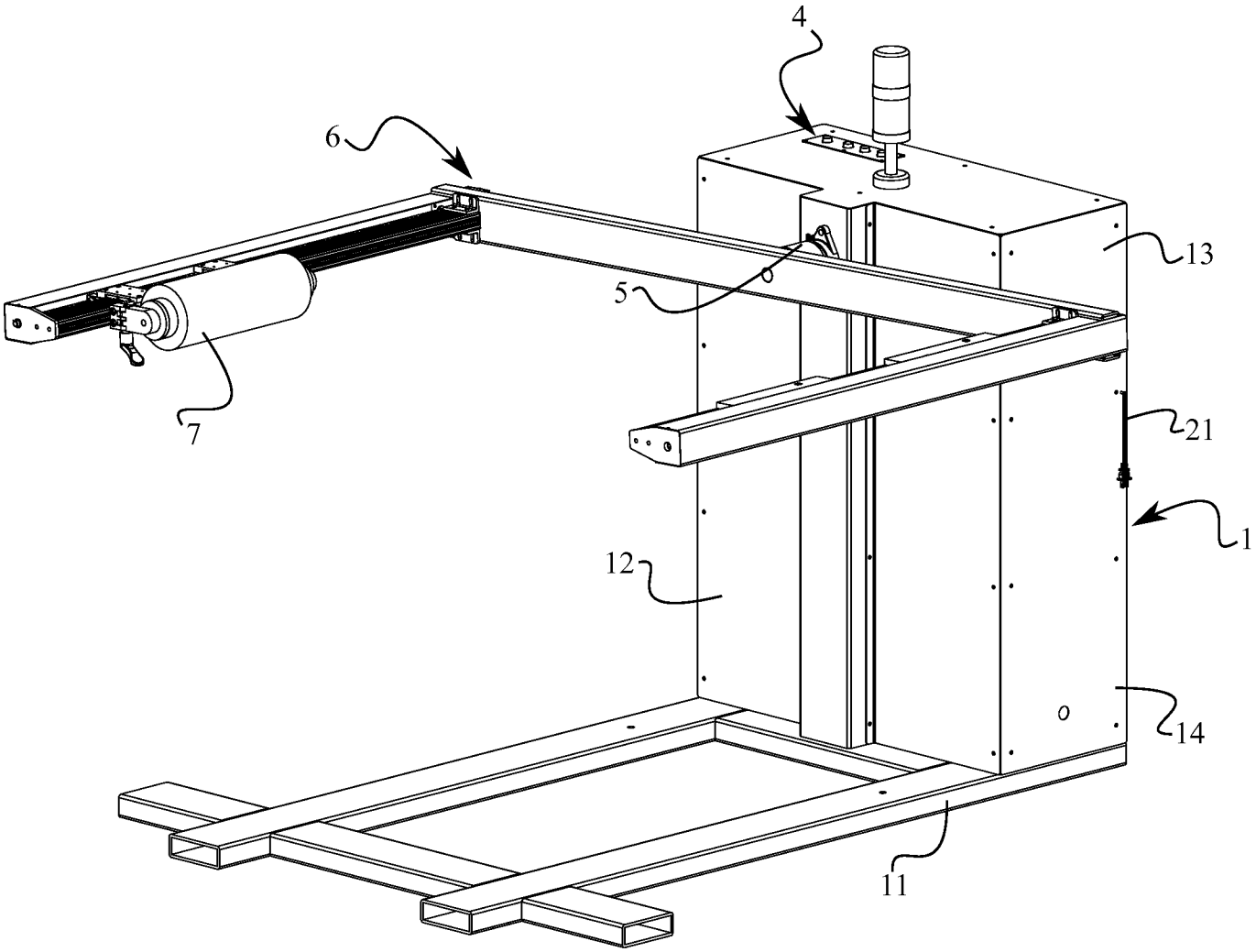
FIG. 1 is a perspective view of the present invention.

In reference to FIG. 1, the present invention is a horizontal plastic stretch wrapping apparatus which comprises a main frame 1, a plurality of control components 2, an electrical enclosure 3, a plurality of control buttons 4, a slip ring 5, a wrapping arm 6, and a wrap dispenser 7. The present invention implements a wrapping process to a skid where a wrapping material is used to hold a load on the skid. The present invention efficiently performs the wrapping process for regular shaped loads or irregular shaped loads. The main frame 1 comprises a horizontal base 11, a vertical base 12, a top half 13, and a bottom half 14. The top half 13 and the bottom half 14 are oppositely positioned on the vertical base 12, and the vertical base 12 is perpendicularly positioned on top of the horizontal base 11. The bottom half 14 is connected to the horizontal base 11 from an end creating the main frame 1. The length of the horizontal base 11 is larger than the height of the vertical base 12 so that the present invention can be securely placed on any kind of flat surface. The present invention is also portable so that it can easily be mover with a lift truck to where it is needed. The main frame 1 comprises a ninety degrees counterclockwise rotated L-shaped where the horizontal base 11 acts as the horizontal section of the rotated L-shaped, and the vertical base 12 acts as the vertical section of the rotated L-shaped. The main frame 1 can be made from steel tubing or any other kind of high strength material that can withstand the weight of other components. The vertical base 12 comprises a recessed space and an access panel. The recessed space can be accessed through the access panel where the access panel can be opened only from appropriate tools and kept locked for the safety purposes of the present invention. In reference to FIG. 4, the plurality of control components 2 and the electrical enclosure 3 are connected to the main frame within the vertical base 12 and positioned inside the recessed space, but the plurality of control buttons 4 is positioned on the vertical base 12.

Figure 2:
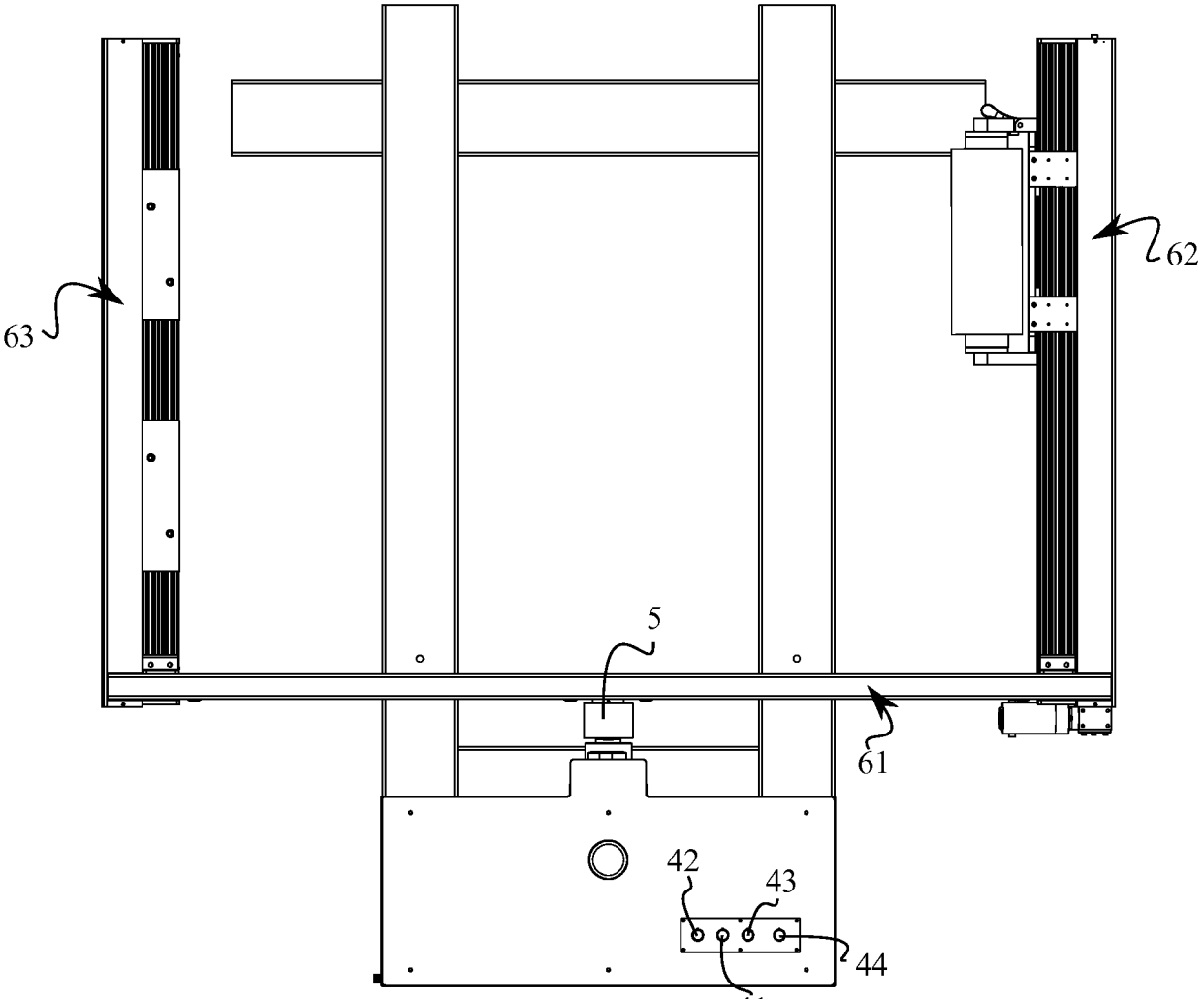
FIG. 2 is a top view of the present invention.

In reference to FIG. 2, the plurality of control buttons 4 comprises a start button 41, a stop button 42, a jog button 43, and an emergency stop button 44. The start button 41, the stop button 42, the jog button 43, and the emergency stop button 44 are electrically connected with terminal blocks 34 where the terminal blocks 34 is positioned within the electrical enclosure 3. The start button 41 powers the present invention while the stop button 42 shuts down the present invention. The emergency stop button 44 functions as an emergency stop for the present invention. The jog button 43 selectively operates the plurality of control components 2.

Figure 12:
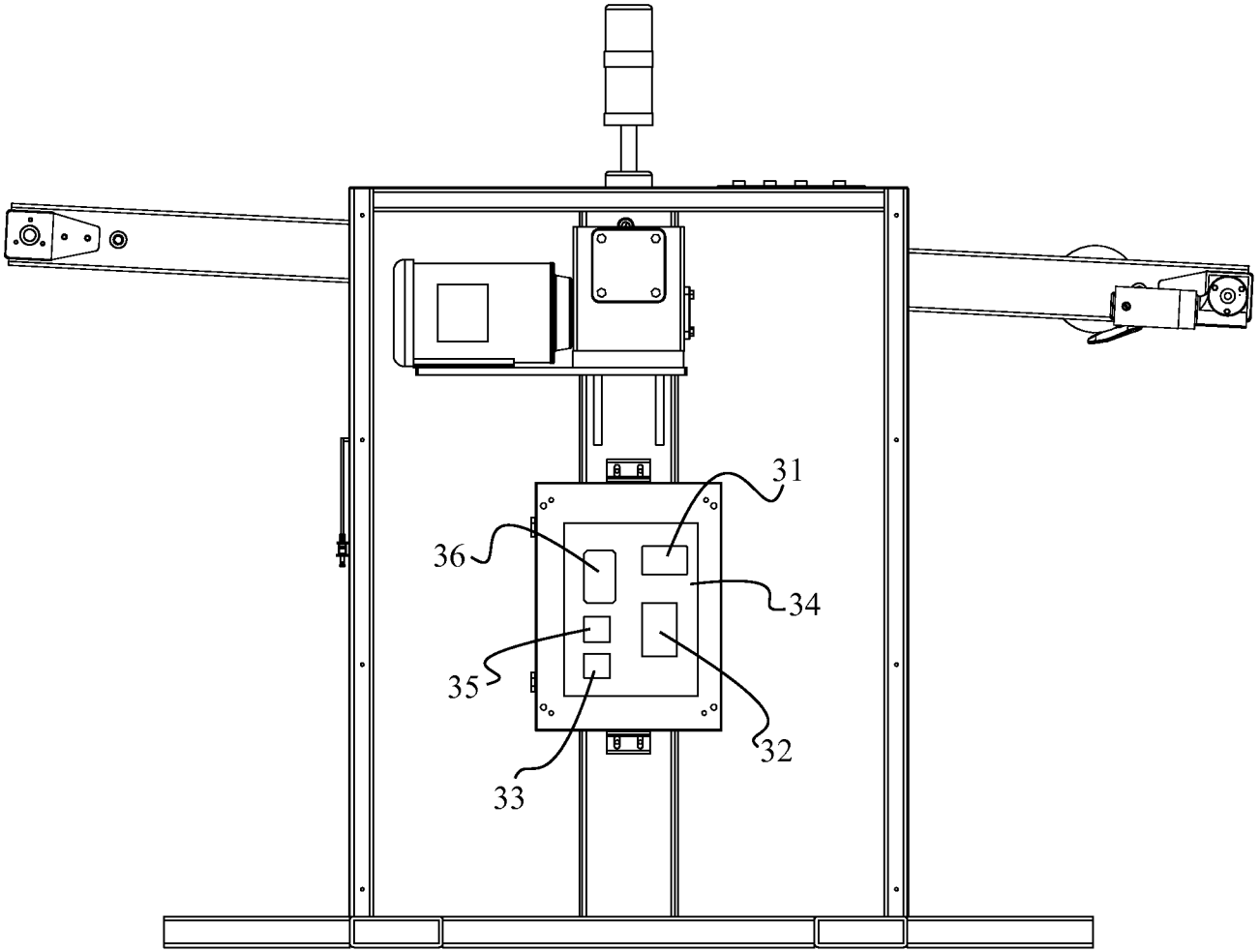
FIG. 12 is a back inside view of an electrical enclosure in the present invention.

In reference to FIG. 12, the electrical enclosure 3 comprises a programmable logic controller (PLC) 31, a rectifier 32, a contactor 33, the terminal blocks 34, a motor controller 35, and a variable-frequency drive 36. The PLC 31, the rectifier 32, the contactor 33, the terminal blocks 34, the motor controller 35, and the variable-frequency drive 36 are positioned within the electrical enclosure 3. The PLC 31 is a device that can be programmed to perform a series of sequence of events. In the present invention, the sequence of events can be programmed by the operators and the manufactures. Once the PLC 31 is programmed, the PLC 31 functions as a computer and performs the sequence of events within the present invention relative to input commands. The PLC 31 is electrically connected to the terminal blocks 34. The rectifier 32 is an electrical device that converts the alternating current into the direct current, and the rectifier 32 is electrically connected to the terminal blocks 34. The direct current from the rectifier 32 provides electrical power to the plurality of control buttons 4 so that the plurality of control buttons 4 can be powered.

The contactor 33 functions as a bridge between the emergency stop button 44 and the terminal blocks 34. Once the emergency stop button 44 is pressed, the contactor 33 disconnects the electric power to the electrical enclosure 3 in the present invention except for the PLC 31 and the rectifier 32. In other words, the emergency stop button 44 stops the sequence of events. The contactor 33 is electrically connected with the emergency stop button 44 and the terminal blocks 34. The motor controller 35 is electrically connected with the PLC 31 through the terminal blocks 34, and the functionality of the motor controller 35 is controlled by the PLC 31. The variable-frequency drive 36 is electrically connected to the PLC 31 through the terminal blocks 34 and to an alternating current (AC) motor 22 in the plurality of control components 2. The variable-frequency drive 36 is controlled by the PLC 31.

Figure 4:
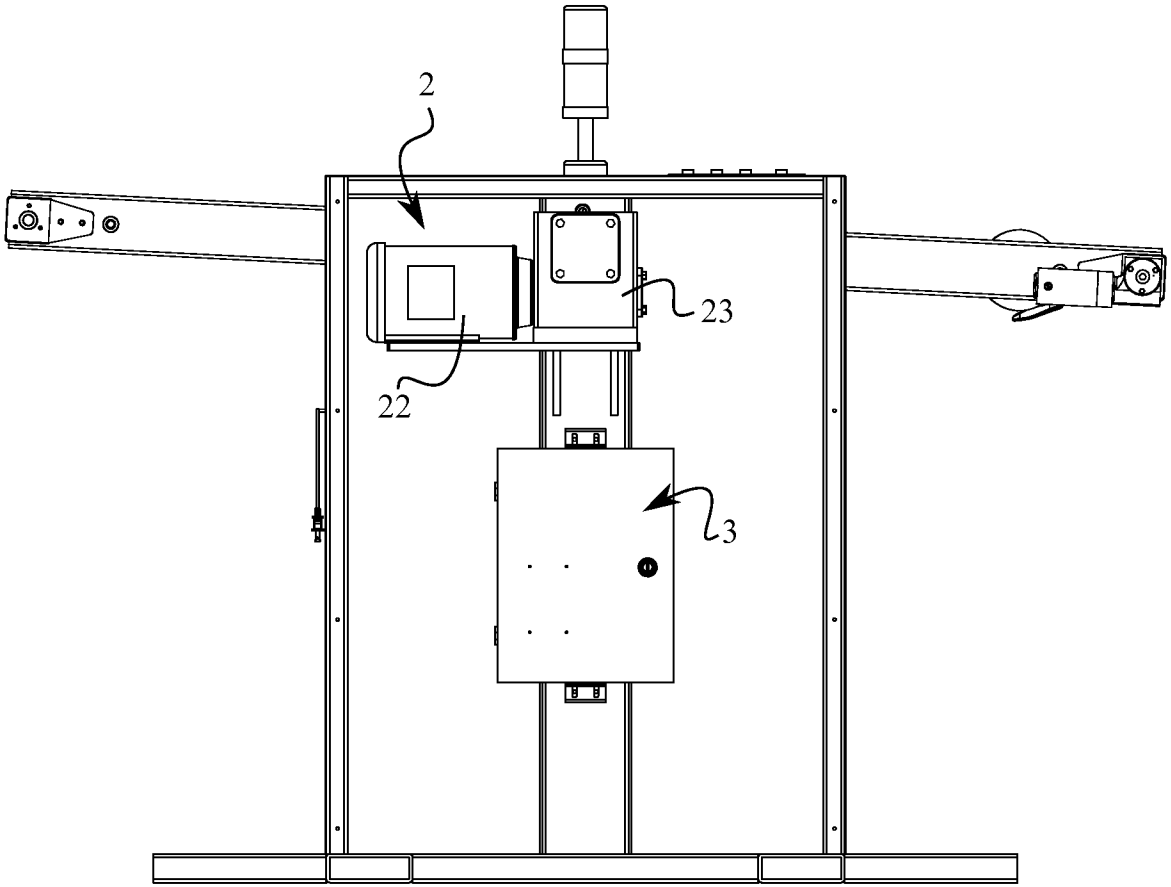
FIG. 4 is a back view of the present invention showing the inside of a vertical base.
Figure 5:
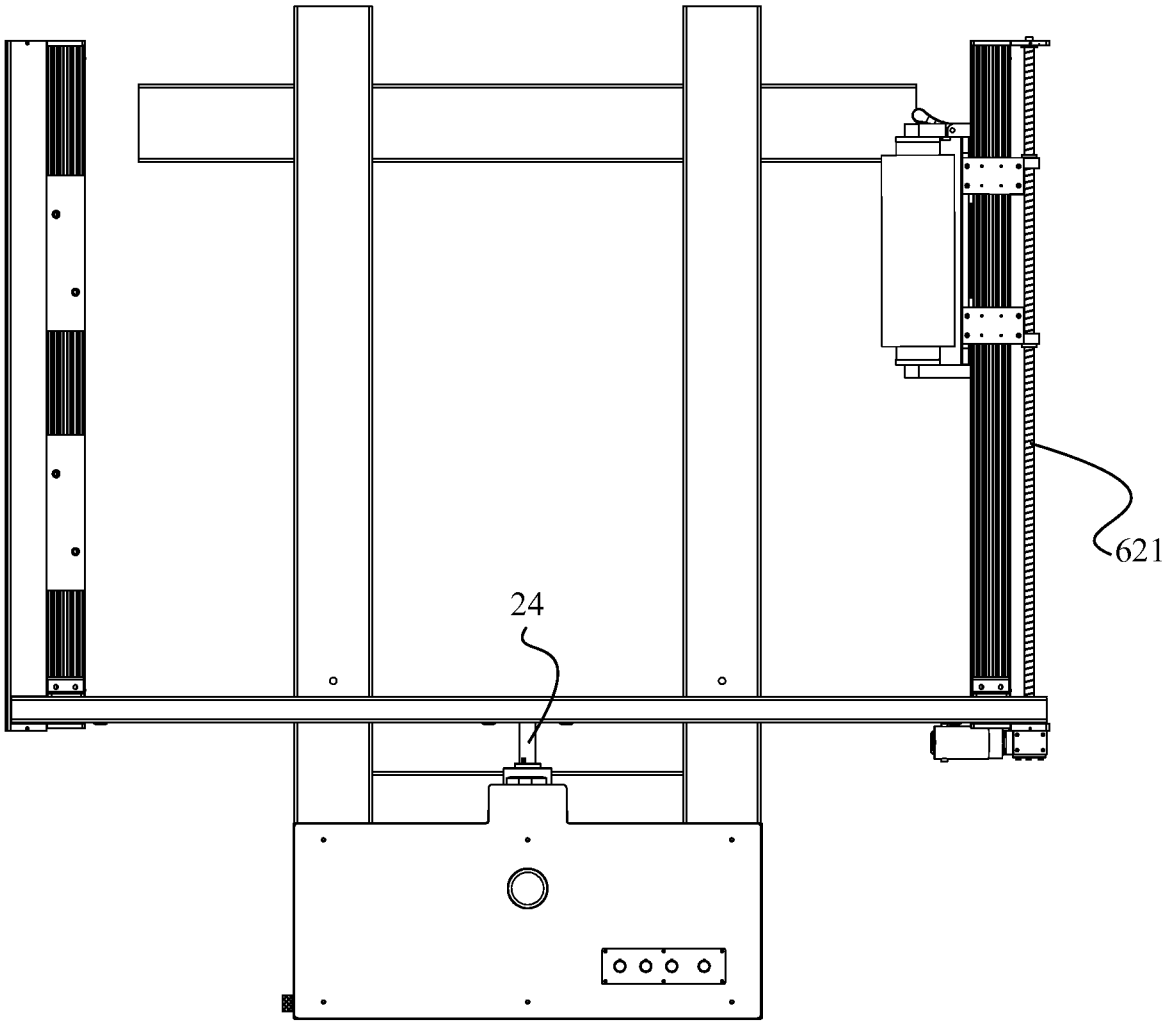
FIG. 5 is a top view of the present invention showing a shaft and a threaded rod.

In reference to FIG. 4 and FIG. 5, the plurality of control components 2 comprises a power connector 21, the AC motor 22, a gearbox 23, and a shaft 24. The power connector 21 is positioned on the vertical base 12 through a side panel on the recessed space, and electrically connected to the terminal blocks 34. The power connector 21 provides the correct power source to the present invention, and can be stored as a pull-out extension cord which can be positioned within the vertical base 12. In the preferred embodiment, the correct power source is a 120 volt alternating current. When the power connector 21 is plugged into a 120 volt alternating current outlet, the electrical enclosure 3 is powered by the 120 volt alternating current. Since the variable-frequency drive 36 is electrically connected with the AC motor 22 and the PLC 31, the variable-frequency drive 36 powers and controls the AC motor 22. The AC motor 22, the gearbox 23, and the shaft 24 are interconnected to each other and the shaft 24 is traversed through the top half 13. When the AC motor 22 rotates the gearbox 23, the shaft 24 rotates with respect to the gearbox 23 converting electrical energy from the variable-frequency drive 36 into mechanical energy in the shaft 24.

Figure 7:
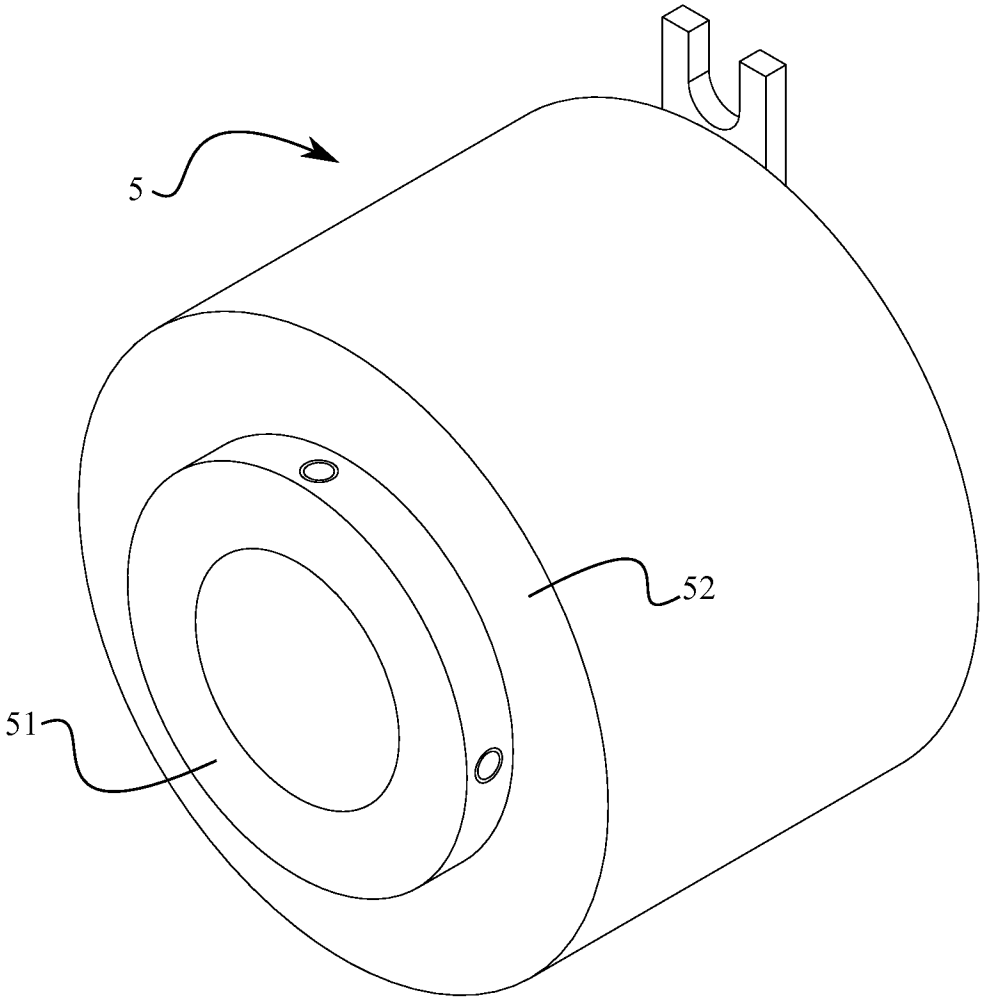
FIG. 7 is a perspective view of a slip ring in the present invention.

In reference to FIG. 7, the slip ring 5 is an electromechanical system that allows continuous rotation while transferring the electrical power and the data from a stationary structure to a rotating structure. In the preferred embodiment, the slip ring 5 comprises an inner ring 51 and an outer ring 52. The inner ring 51 is concentrically and movably positioned inside the outer ring 52 and, the inner ring 51 is electrically connected to the outer ring 52. The inner ring 51 is concentrically connected to the shaft 24. The outer ring 52 is firmly connected to the vertical base 12 and electrically connected with the motor controller 35 and the PLC 31. Since the inner ring 51 is connected to the shaft 24, the inner ring 51 functions as the rotating structure. At the same time, the outer ring 52 is connected to the vertical base 12 where the outer ring 52 functions as the stationary structure.

In reference to FIG. 2, the wrapping arm 6 comprises a cross arm 61, a first arm 62, and a second arm 63. The cross arm 61 is adjacently positioned in front of the slip ring 5 and centrally connected to the shaft 24. The cross arm 61 comprises a first end 612, a second end 613, a direct current (DC) motor 611. The first end 612 and the second end 613 are oppositely positioned ends of the cross arm 61. The DC motor 611 is positioned in between the cross arm 61 and the vertical base 12 and adjacently connected to the cross arm 61 from the first end 612. The DC motor 611 is electrically connected to the inner ring 51 where the DC motor 611 is controlled and powered by the by motor controller 35. The first arm 62 and the second arm 63 are adjacently positioned with the vertical base 12 and the horizontal base 11. The first arm's 62 bottom end is perpendicularly connected to the cross arm 61 and adjacently positioned with the DC motor 611. The second arm's 63 bottom end is perpendicularly connected to the cross arm 61 from the second end 613 and oppositely positioned from the first arm 62. The cross arm 61, the first arm 62, and the second arm 63 can be made from 80/20 brand extruded aluminum or any other type of high strength and light weighted material.

Figure 3:
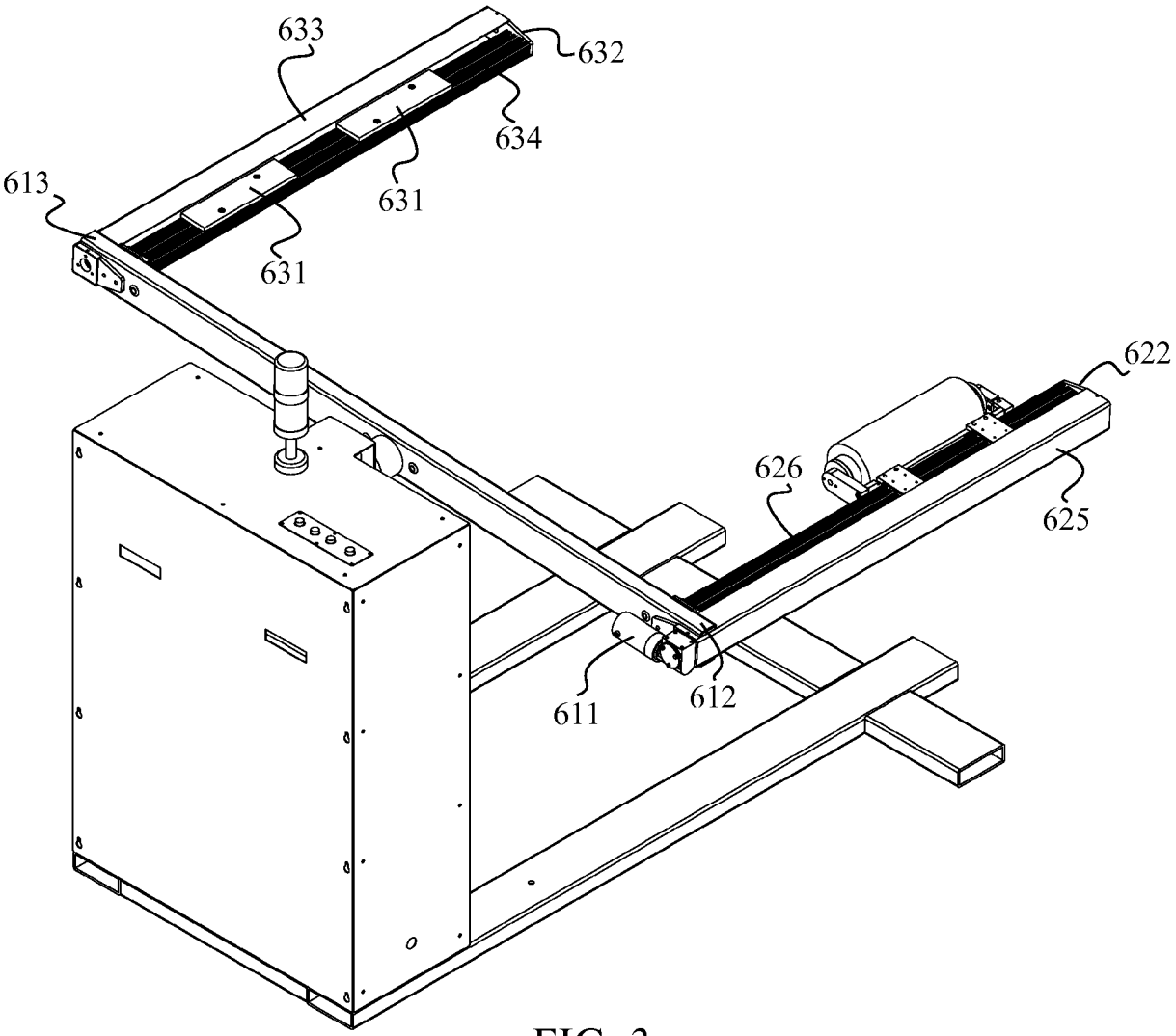
FIG. 3 is a back perspective view of the present invention.
Figure 6:
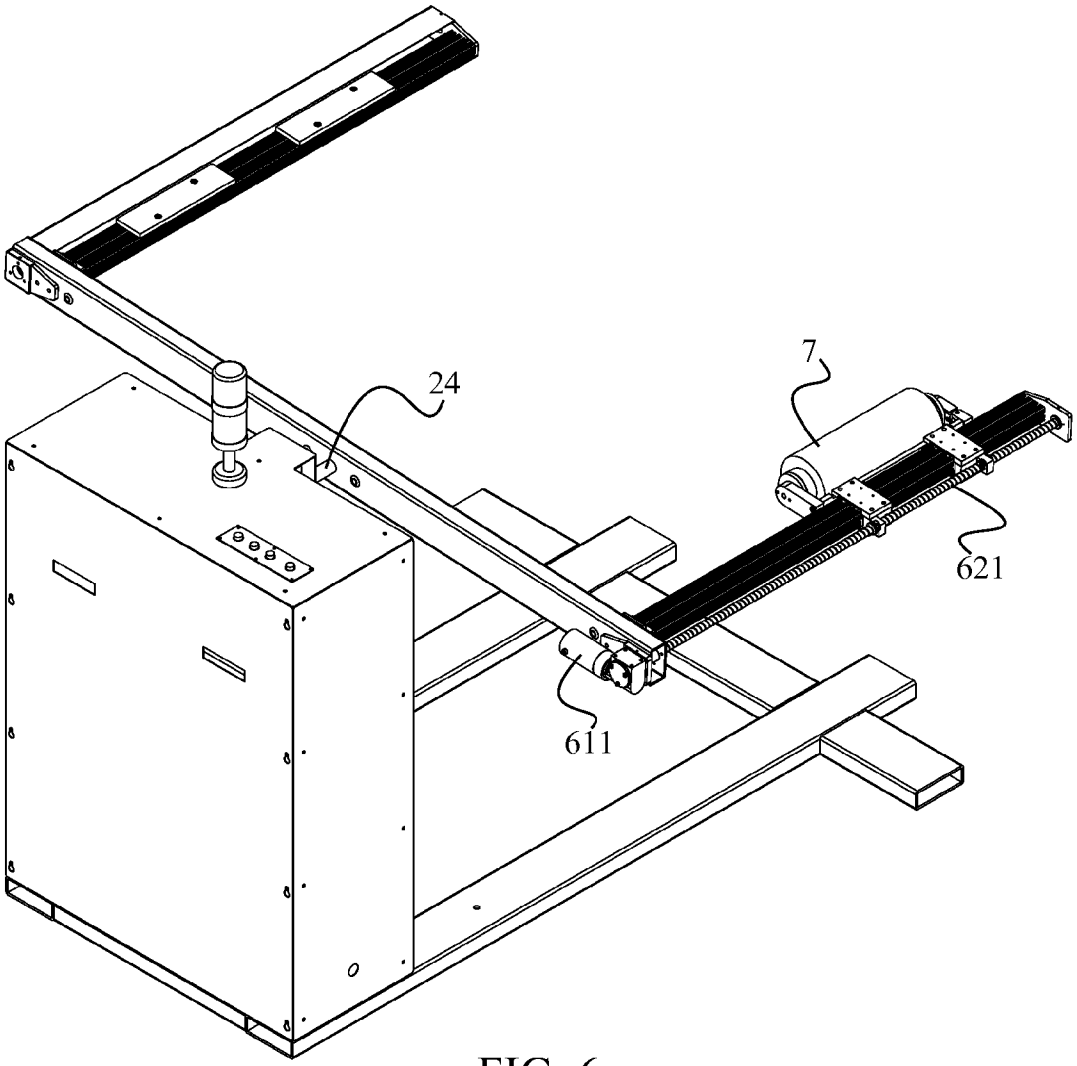
FIG. 6 is a back perspective view of the present invention showing the shaft and the threaded rod.
Figure 8:
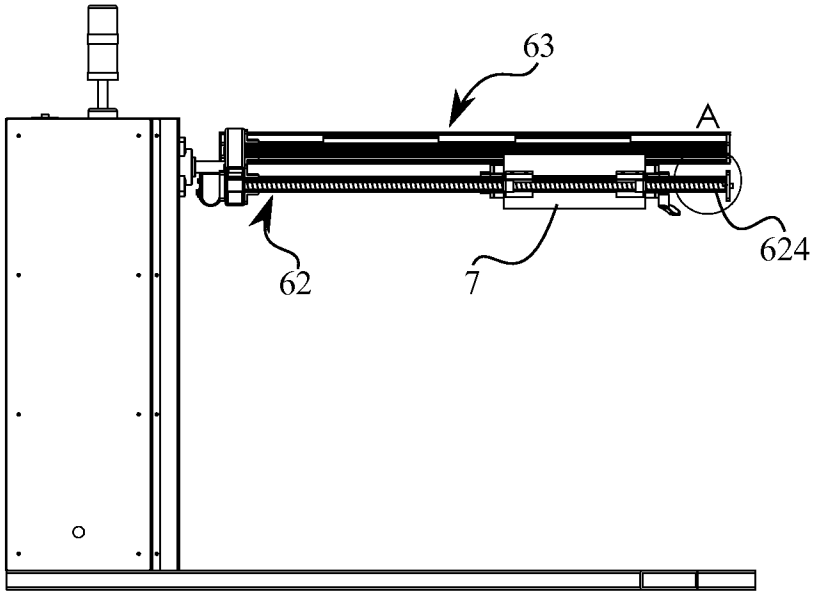
FIG. 8 is a side view of the present invention showing a second reflective sensor.
Figure 9:
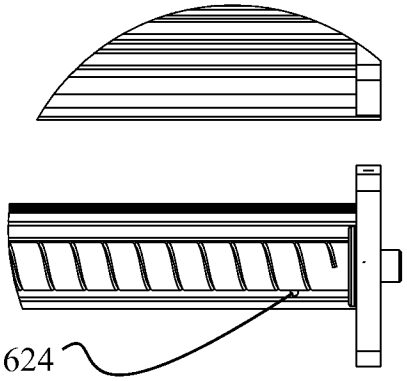
FIG. 9 is a detail view of the second reflective sensor in the present invention.
Figure 11:
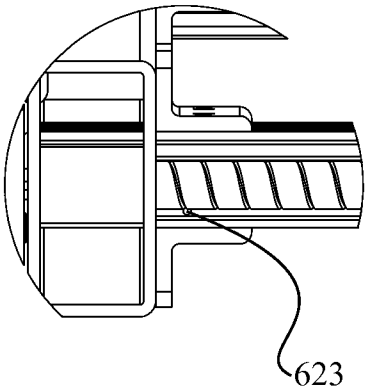
FIG. 11 is a detail view of the first reflective sensor in the present invention.
Figure 10:
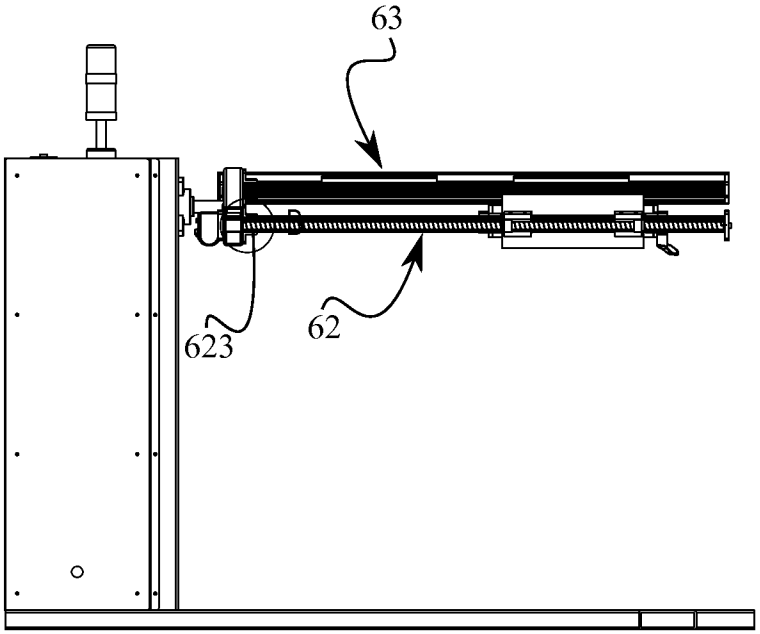
FIG. 10 is a side view of the present invention showing a first reflective sensor.

In reference to FIG. 3 and FIG. 6, the first arm 62 comprises a threaded rod 621, a first end cap 622, a first reflective sensor 623, a second reflective sensor 624, a first protective cover 625, and a first railing 626. The threaded rod 621, the first protective cover 625, and first railing 626 are positioned parallel to each other where the first protective cover 625 is attached to the first railing 626. The first end cap 622 is perpendicularly positioned with the first protective cover 625 and the first railing 626 and connected to top end of the first arm 62. The threaded rod 621 is movably traversed through the first end cap 622 and the cross arm 61 where the threaded rod 621 is positioned within the first protective cover 625. The threaded rod 621 is then connected with the DC motor 611. Since the threaded rod 621 is connected to the DC motor 611, the threaded rod 621 is rotated by the DC motor 611. In reference to FIG. 10 and FIG. 11, the first reflective sensor 623 is connected to the first arm 62 and adjacently positioned with the DC motor 611. In reference to FIG. 8 and FIG. 9, the second reflective sensor 624 is also connected to the first arm 62 and adjacently positioned from the first end cap 622. The first reflective sensor 623 and the second reflective sensor 624 are electrically connected with the PLC 31 and the rectifier 32 through the slip ring 5. The first reflective sensor 623 and the second reflective sensor 624 are powered with direct current, and the direct current is distributed from the rectifier 32. In reference to FIG. 3, the second arm 63 comprises a plurality of counter weights 631, a second end cap 632, a second protective cover 633, and a second railing 634. The second protective cover 633 is connected to the second railing 634 and positioned parallel to each other. The second end cap 632 is perpendicularly positioned with the second protective cover 633 and the second railing 634 and connected to top end of the second arm 63. The plurality of counter weights 631 is attached to the second railing 634. When the wrapping arm 6 rotates during the wrapping process, the plurality of counter weights 631 maintains an equilibrium system within the wrapping arm 6 so that steady rotation can be achieved.

In reference to FIG. 6, the wrap dispenser 7 is movably aligned along the first railing 626 where the threaded rod 621 is threaded through the wrap dispenser 7. Since the wrap dispenser 7 is aligned with the first railing 626, the wrap dispenser 7 is able to move back and forth along the first arm 62. For example, when the threaded rod 621 rotates in clockwise direction, the wrap dispenser 7 travels from the cross arm 61 to the first end cap 622. At the same time, when the threaded rod 621 rotates in the counterclockwise direction, the wrap dispenser 7 travels from the first end cap 622 to the cross arm 61. In the preferred embodiment, a stretch wrap roll is inserted into the wrap dispenser 7 where the stretch wrap roll is considered as the wrapping material.

In order for the present invention to implements the wrapping process to the skid, the skid needs to be held in the air horizontally by the lift truck. At the start of the wrapping process, the wrap dispenser 7 is positioned adjacent to the first end cap 622. The operator then attaches the stretch wrap from the stretch wrap roll to the skid and presses the start button 41. After the start button 41 is pressed for at least three seconds, the start button 41 allows the electrical enclosure 3 to obtain the 120 volt alternating current through the power connector 21. Then the AC motor 22 is powered through the variable-frequency drive 36, and the DC motor 611 is powered through the motor controller 35. When the AC motor 22 is powered, the AC motor 22 rotates the wrapping arm 6 around the skid. Since the stretch wrap is attached to the skid, the wrap dispenser 7 starts to dispense the stretch wrap as the wrap dispenser 7 moves around the skid. The wrap dispenser 7 is controlled by the PLC 31 to dispense the stretch wrap until the wrapping arm 6 completes at least two full first cycles around the starting end of the skid. Once the wrapping arm 6 completes the at least two full first cycles, the wrap dispenser 7 starts moving toward the vertical base 12 while dispensing the stretch wrap. The movement of the wrap dispenser 7 is accomplished by the DC motor 611 where the DC motor 611 is controlled by the PLC 31. Each revolution of the wrapping arm 6 overlaps a specific distance from the previous revolution. If the operator needs to change the specific distance between the each revolution, the specific distance can be changed by re- programming the PLC 31. When the wrap dispenser 7 positions next to the first reflective sensor 623, the first reflective sensor 623 relays the positioning of the wrap dispenser 7 to the PLC 31. Then the PLC 31 stops the wrap dispenser 7 from moving along the first arm 62 but continuous to wrap at least two full end cycles around the finishing end of the skid. Once the at least two full end cycles is completed, the wrapping arm 6 stops rotating around the skid and comes to a complete stop. The positioning of the wrapping arm 6 after the complete stop and the initial positioning of the wrapping arm 6 is relatively similar to each other. After the wrapping arm 6 comes to the complete stop, the plastic stretch wrap is cut and attached to the skid. At this point the skid can be removed away from the present invention by the lift truck.

In order to repeat the entire wrapping process, the wrap dispenser 7 needs to return to the initial position. The start button 41 is pushed once again so that the wrap dispenser 7 moves back into the initial position without the wrapping arm 6 rotating around the skid. When the wrap dispenser 7 reaches to the initial position, the second reflective sensor 624 relays the positioning of the wrap dispenser 7 to the PLC 31. Then the PLC 31 commands the motor controller 35 to stop movement of the wrap dispenser 7. After the wrap dispenser reaches to the initial position, the present invention can repeat the entire wrapping process again.

The stop button 42 allows the operator to stop the present invention from functioning during the wrapping process. If the operator wants to manually stop the present invention before the wrap dispenser 7 reaches the first reflective sensor 623, the operator can press the stop button 42 which stops the present invention from performing the wrapping process.

The jog button 43 allows the operator to selectively operate the present invention. The jog button 43 has to be pressed and held by the operator so that the present invention can be powered. For example, if the operator has a smaller skid, the operator can used the jog button 43 to wrap the small skid. When the jog button 43 is pressed and held, the wrap dispenser 7 starts wrapping the small skid. Once the jog button 43 is released, the wrap dispenser 7 stops wrapping the small skid.

The present invention may also function with an optional wrap dispenser for additional strength. The optional wrap dispenser may be connected to the second arm 63 by removing the plurality of counter weights 631. In order for the optional wrap dispenser to function, the second arm 63 would be occupied with necessary components so that the optional wrap dispenser can be simultaneously functioned with the wrap dispenser 7. In order to improve the efficiency of the present invention relative to the optional wrap dispenser, a selective switch may be placed within the plurality of control buttons 4. The selective switch allows the wrap dispenser 7 and the optional wrap dispenser to individually function from one another or simultaneously function at the same time.

Although the invention has been explained in relation to its preferred embodiment, it is to be understood that many other possible modifications and variations can be made without departing from the spirit and scope of the invention as hereinafter claimed.

What is claimed is:

1. A horizontal plastic stretch wrapping apparatus comprises, a main frame;

a plurality of control components;

an electrical enclosure;

a plurality of control buttons;

a slip ring;

a wrapping arm;

a wrap dispenser;

the main frame comprises a horizontal base, a vertical base, a top half, and a bottom half;

the plurality of control components comprises a power connector, an alternating current (AC) motor, a gearbox, and a shaft;

the electrical enclosure comprises a programmable logic controller (PLC), a rectifier, a contactor, terminal blocks, a variable-frequency drive, and a motor controller;

the plurality of control buttons comprises a start button, a stop button, a jog button, and an emergency stop button;

the slip ring comprises an inner ring and an outer ring; and the wrapping arm comprises a cross arm, a first arm, and a second arm.

2. The horizontal plastic stretch wrapping apparatus claimed in claim 1 comprises, the top half and the bottom half being oppositely positioned on the vertical base;

the vertical base being perpendicularly positioned with the horizontal base from the bottom half;

the bottom half being connected with the horizontal base from an end;

the plurality of control buttons being positioned on the top half; and the start button, the stop button, the jog button, and the emergency stop button being electrically connected with the terminal blocks.

3. The horizontal plastic stretch wrapping apparatus claimed in claim 1 comprises, the AC motor and the gear box being positioned within the vertical base;

the power connector being electrically connected to the terminal blocks and being positioned on the vertical base;

the AC motor being electrically connected with the variable-frequency drive;

the AC motor being adjacently connected with the gearbox;

the shaft being adjacently connected with the gearbox; and the shaft being traversed through the top half.

4. The horizontal plastic stretch wrapping apparatus claimed in claim 1 comprises, the electrical enclosure being positioned within the vertical base;

the PLC, the rectifier, the contactor, the variable-frequency drive, and the motor controller being electrically connected to the terminal blocks;

the contactor being electrically connected with the emergency stop button; and the rectifier being electrically connected with the plurality of control buttons.

5. The horizontal plastic stretch wrapping apparatus claimed in claim 1 comprises, the inner ring being concentrically positioned within the outer ring;

the inner ring being electrically connected with the outer ring;

the inner ring being concentrically connected to the shaft;

the outer ring being securely connected to the vertical base; and the outer ring being electrically connected with the motor controller, the rectifier, and the PLC.

6. The horizontal plastic stretch wrapping apparatus claimed in claim 1 comprises, the cross arm comprises a first end, a second end, and a direct current (DC) motor;

the first end and the second being oppositely positioned on the cross arm;

the DC motor being connected to the cross arm from the first end;

the DC motor being electrically connected with the inner ring;

the cross arm being adjacently positioned with the slip ring and centrally connected to the shaft in between the first end and the second end;

the first arm and the second arm being adjacently positioned with the vertical base and the horizontal base;

the first arm being perpendicularly connected to the cross arm and adjacently positioned with the first end;

the second arm being perpendicularly connected to the cross arm and adjacently positioned with the second end; and the wrap dispenser being movably connected to the first arm.

7. The horizontal plastic stretch wrapping apparatus claimed in claim 6 comprises, the first arm comprises a threaded rod, a first end cap, a first reflective sensor, a second reflective sensor, a first protective cover, and a first railing;

the threaded rod, the first railing, and the first protective cover being positioned parallel to each other;

the first protective cover being attached to the first railing;

the first end cap being oppositely positioned from the cross arm and perpendicularly connected with the first railing and the first protective cover;

the first reflective sensor being connected to the first arm and adjacently positioned with the DC motor;

the second reflective sensor being connected to the first arm and adjacently positioned with the first end cap;

the first reflective sensor and the second reflective sensor being electrically connected to with the inner ring;

the wrap dispenser being aligned along the first railing;

the threaded rod being movably traversed through the first end cap and the cross arm;

the threaded rod being threaded through the wrap dispenser; and the threaded rod being connected to the DC motor.

8. The horizontal plastic stretch wrapping apparatus claimed in claim 6 comprises, the second arm comprises a plurality of counter weights, a second end cap, a second protective cover, and a second railing;

the second protective cover and the second railing being positioned parallel to each other;

the second protective cover being attached to the second railing;

the second end cap being oppositely positioned from the cross arm and perpendicularly connected with the second railing and the second protective cover; and the plurality of counter weights being attached to the second railing.

9. A horizontal plastic stretch wrapping apparatus comprises, a main frame;

a plurality of control components;

an electrical enclosure;

a plurality of control buttons;

a slip ring;

a wrapping arm;

a wrap dispenser;

the main frame comprises a horizontal base, a vertical base, a top half, and a bottom half;

the plurality of control components comprises a power connector, an alternating current (AC) motor, a gearbox, and a shaft;

the electrical enclosure comprises a programmable logic controller (PLC), a rectifier, a contactor, terminal blocks, a variable-frequency drive, and a motor controller;

the plurality of control buttons comprises a start button, a stop button, a jog button, and an emergency stop button;

the slip ring comprises an inner ring and an outer ring;

the wrapping arm comprises a cross arm, a first arm, and a second arm;

the AC motor, the gear box, and the shaft and the electrical enclosure being positioned within the vertical base;

the plurality of control buttons being positioned on the vertical base;

the wrapping arm being movably connected to the vertical base; and the wrap dispenser being movably connected to the first arm.

10. The horizontal plastic stretch wrapping apparatus claimed in claim 9 comprises, the top half and the bottom half being oppositely positioned on the vertical base;

the vertical base being perpendicularly positioned with the horizontal base from the bottom half;

the bottom half being connected with the horizontal base from an end;

the plurality of control buttons being positioned on the top half; and the start button, the stop button, the jog button, and the emergency stop button being electrically connected with the terminal blocks.

11. The horizontal plastic stretch wrapping apparatus claimed in claim 9 comprises, the power connector being electrically connected to the terminal blocks and being positioned on the vertical base;

the AC motor being electrically connected with the variable-frequency drive;

the AC motor being adjacently connected with the gearbox;

the shaft being adjacently connected with the gearbox; and the shaft being traversed through the top half.

12. The horizontal plastic stretch wrapping apparatus claimed in claim 9 comprises, the PLC, the rectifier, the contactor, the variable-frequency drive, and the motor controller being electrically connected to the terminal blocks;

the contactor being electrically connected with the emergency stop button; and the rectifier being electrically connected with the plurality of control buttons.

13. The horizontal plastic stretch wrapping apparatus claimed in claim 9 comprises, the inner ring being concentrically positioned within the outer ring;

the inner ring being electrically connected with the outer ring;

the inner ring being concentrically connected to the shaft;

the outer ring being securely connected to the vertical base; and the outer ring being electrically connected with the motor controller, the rectifier, and the PLC.

14. The horizontal plastic stretch wrapping apparatus claimed in claim 9 comprises, the cross arm comprises a first end, a second end, and a direct current (DC) motor;

the first end and the second being oppositely positioned on the cross arm;

the DC motor being connected to the cross arm from the first end;

the DC motor being electrically connected with the inner ring;

the cross arm being adjacently positioned with the slip ring and centrally connected to the shaft in between the first end and the second end;

the first arm and the second arm being adjacently positioned with the vertical base and the horizontal base;

the first arm being perpendicularly connected to the cross arm and adjacently positioned with the first end; and the second arm being perpendicularly connected to the cross arm and adjacently positioned with the second end.

15. The horizontal plastic stretch wrapping apparatus claimed in claim 14 comprises, the first arm comprises a threaded rod, a first end cap, a first reflective sensor, a second reflective sensor, a first protective cover, and a first railing;

the threaded rod, the first railing, and the first protective cover being positioned parallel to each other;

the first protective cover being attached to the first railing;

the first end cap being oppositely positioned from the cross arm and perpendicularly connected with the first railing and the first protective cover;

the first reflective sensor being connected to the first arm and adjacently positioned with the DC motor;

the second reflective sensor being connected to the first arm and adjacently positioned with the first end cap;

the first reflective sensor and the second reflective sensor being electrically connected to with the inner ring;

the wrap dispenser being aligned along the first railing;

the threaded rod being movably traversed through the first end cap and the cross arm;

the threaded rod being threaded through the wrap dispenser; and the threaded rod being connected to the DC motor.

16. The horizontal plastic stretch wrapping apparatus claimed in claim 14 comprises, the second arm comprises a plurality of counter weights, a second end cap, a second protective cover, and a second railing;

the second protective cover and the second railing being positioned parallel to each other;

the second protective cover being attached to the second railing;

the second end cap being oppositely positioned from the cross arm and perpendicularly connected with the second railing and the second protective cover; and the plurality of counter weights being attached to the second railing.

* * * * *